United States Patent [19]

Marker

[11] 4,037,553

[45] July 26, 1977

[54] APPARATUS FOR CONNECTING A SAILING MAST TO A SAILING BOARD

[76] Inventor: Hannes Marker, Hauptstrasse 51-53, 81 Garmisch-Partenkirchen, Germany

[21] Appl. No.: 622,512

[22] Filed: Oct. 15, 1975

[30] Foreign Application Priority Data

Oct. 18, 1974 Germany ..... 2449636

[51] Int. Cl.[2] ..... B63B 15/00

[52] U.S. Cl. ..... 114/91; 9/310 E; 114/39

[58] Field of Search ..... 9/310 E; 114/93, 90, 114/91, 39

[56] References Cited

U.S. PATENT DOCUMENTS

| | | | |
|---|---|---|---|
| 641,321 | 1/1900 | Perkins | 114/91 |
| 2,466,006 | 9/1946 | Danko | 114/133 |
| 3,487,800 | 1/1970 | Schweitzer et al. | 114/91 |
| 3,507,240 | 4/1970 | Butler | 114/91 |
| 3,707,935 | 1/1973 | Rachie | 114/39 |

FOREIGN PATENT DOCUMENTS

| | | | |
|---|---|---|---|
| 2,423,251 | 11/1975 | Germany | 114/39 |
| 1,914,604 | 10/1969 | Germany | |
| 2,352,097 | 5/1974 | Germany | |

*Primary Examiner*—Trygve M. Blix
*Assistant Examiner*—Gregory W. O'Connor
*Attorney, Agent, or Firm*—Fleit & Jacobson

[57] ABSTRACT

The foot of a mast is connected to a sailing board on which the user stands while also holding the mast during sailing. The location of the connection is variable longitudinally of the board during sailing, whereby the most favorable point of application of the wind force to the board can be selected by the user.

5 Claims, 3 Drawing Figures

APPARATUS FOR CONNECTING A SAILING MAST TO A SAILING BOARD

The present invention relates to apparatuses for connecting a sailing mast to a sailing board. Such apparatuses are very simply constructed and consist generally of a supporting plate that is applied to the sailing board for supporting purposes and is rigidly connected to the foot of the mast by means of a universal joint. On its underface, the supporting plate has a tongue which depends therefrom at right-angles and is provided for engagement in a complementary recess in the sailing board and thus for achieving a releasable plug connection. To ensure retention adequate for normal use, the tongue often also carries a clamping spring. For transport and storage of the sailing board, the sailing mast can thus be readily dismantled by releasing the plug connection.

In practice, it has now been shown that the hitherto conventional sailing boards have a disadvantage that becomes particularly noticeable when the sailing boards are used for racing purposes. This disadvantage resides in the fact that the sailing boards provide no possibility for changing the point of application of the propelling force during sailing.

It is therefore the aim of the present invention to avoid this disadvantage.

This is achieved according to the invention in that the apparatus, as viewed longitudinally of the sailing board, has at least two fixed connecting points for the mast and, between same, lateral mast guiding means so that the point of application of the propelling force on the sailing board can be changed at will by the user during sailing.

A simple embodiment of the invention consists in that at least one lever is pivoted to a supporting plate provided on the sailing board, which lever is pivotable relatively to the sailing board about a horizontal transverse axis from a first to a second limiting position, in which limiting positions the lever is disposed at least approximately parallel to the sailing board, and that a universal joint carrying the foot of the mast is connected to the free end of the lever by a shaft parallel to its pivotal axis. In its limiting positions, the lever is normally held secure because it is loaded by the propelling force. Switching the lever for the purpose of altering the point of application of the propelling force is carried out by the user at an instant at which the sail is not loaded, namely simply by lifting and then again lowering the sailing mast (which is in any case held by him) through an arc that is predetermined by the lever.

In a constructional development of this inventive concept, at least one pair of levers may be provided and form a parallelogram linkage with a carrier plate, the universal joint engaging the carrier plate. In this way an extremely stable connection is achieved between the supporting plate and the sailing mast.

A different apparatus according to the invention with more than two fixed connecting points for the mast is achieved in that a supporting plate provided on the sailing board has a rack and that a universal joint carrying the foot of the mast possesses at its lower end at least one counter-tooth for engaging in a gap between teeth. Mast adjustment by the user is here effected principally in the same way as in the previously mentioned embodiment. A releasable safety yoke is preferably connected to the supporting plate and prevents release of the mast from the supporting plate in its position of use.

What is important is that the user can carry out the adjustment while standing because he must continuously hold the sailing mast and hold it and himself in equilibrium.

Two examples of the invention will now be described with reference to the accompanying drawings, wherein.

Figure 1:
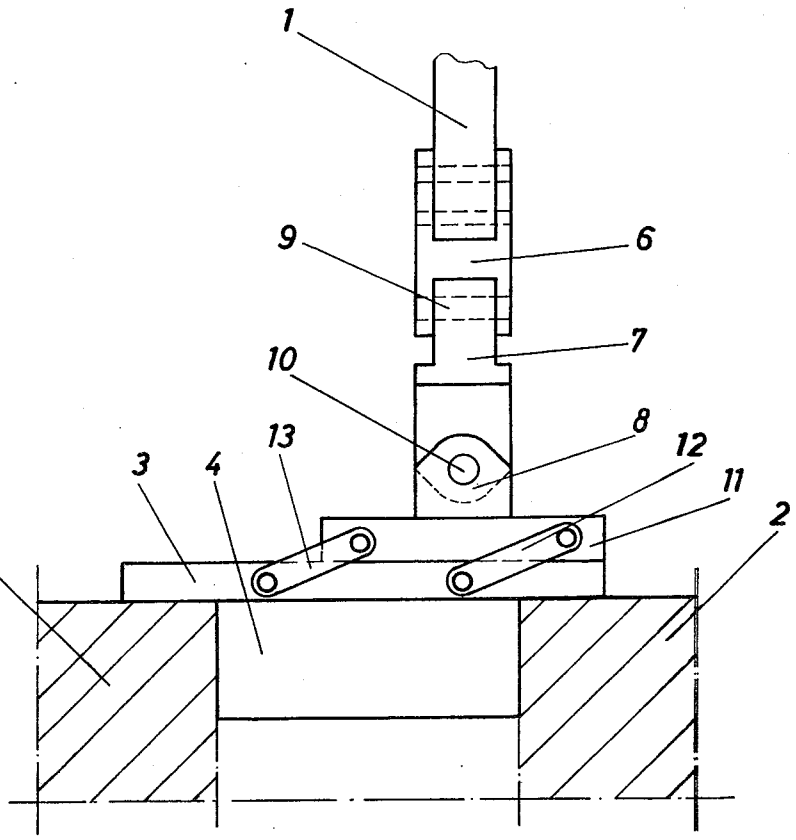
FIG. 1 is a side elevation of an apparatus for connecting a sailing mast to a sailing board.
Figure 2:
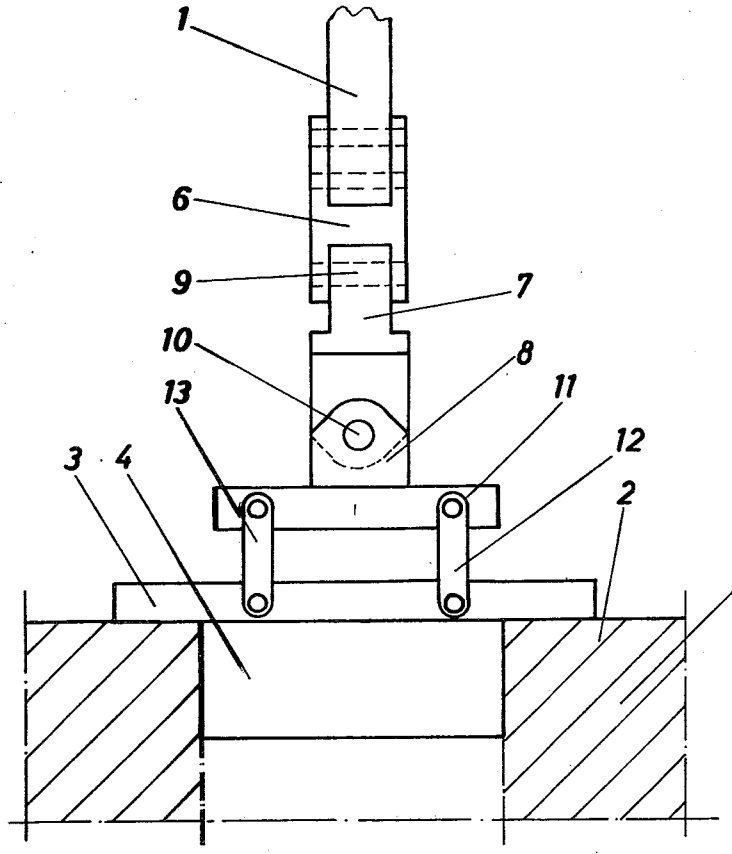
FIG. 2 shows the FIG. 1 apparatus at the instant of transferring from a first to a second limiting position.

In FIGS. 1 and 2 a sailing mast of which only the foot is illustrated is designated 1. Only the connecting region of a sailing board 2 is illustrated in cross-section. A supporting plate 3 lies on the sailing board and has a tongue 4 which is a fit in a recess 5 of the sailing board 2. In this way a releasable plug connection is formed between the sailing board and the sailing mast which, as hereinafter described, is connected to the supporting plate.

The foot of the sailing mast 1 is held against movement in an upper bifurcated member 6 of a universal joint which also comprises a coupling member 7 and a lower bifurcated member 8. The coupling member is pivotally connected to the two bifurcated members by a respective shaft 9 or 10, the shafts being disposed at right-angles to one another in parallel planes. The lower bifurcated member 8 is fixed to a carrier plate 11 which is connected to the supporting plate 3 by one pair of levers 12, 13 at each longitudinal side. Since the levers are parallel to one another and of equal length, a parallelogram linkage is formed.

In this way two fixed connecting points are provided on the sailing board 2 for the mast 1. In FIG. 1 the mast is in its right-hand connecting point as viewed in the drawing. If the user now wishes to change the point of application of the propelling force on the sailing board, he simply lifts the sailing mast 1, as shown in FIG. 2, and then lowers it on the other side. This adjustment can be carried out by the user during sailing in the standing position because he is holding the sailing mast. In the two limiting positions the sailing mast is securely held to the sailing board because the sailing mast presses the carrier plate 11 tightly onto the supporting plate 3 under its own weight and under the force of the wind.

Figure 3:
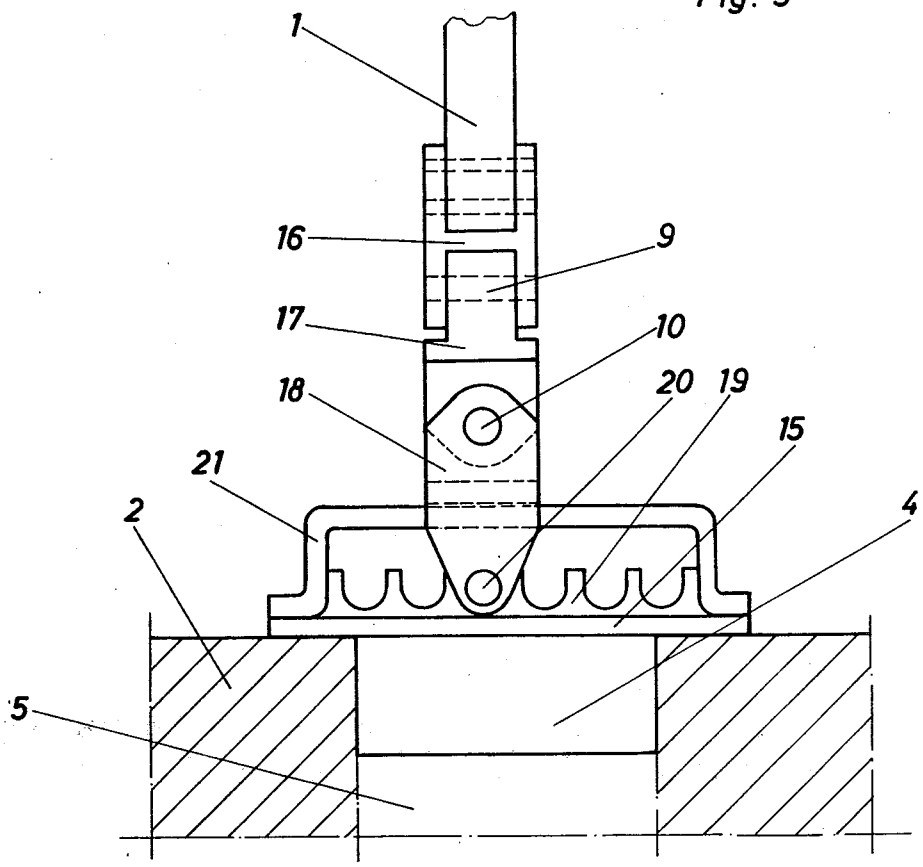
FIG. 3 is a side elevation of an apparatus according to a second embodiment.

FIG. 3 shows a second embodiment of an apparatus for connecting a sailing mast 1 to a sailing board 2. In this embodiment there is a supporting plate 15 which, as the supporting plate 3 of FIGS. 1 and 2, comprises a tongue 4 engaging in a recess 5 of the sailing board 2 and forming the releasable plug connection between the mast and the sailing board. The sailing mast 1 is again rigidly connected to the upper bifurcated member 16 of a universal joint which, similar to the previously described embodiment, also comprises the coupling member 17 and the lower bifurcated member 18. The two shafts lying at right-angles to one another are again designated 9 and 10.

In this embodiment the supporting plate 15 possesses a rack 19. The lower bifurcated member 18 of the universal joint carries at its free end a pin 20 which serves as a counter-tooth and is engaged in a gap between the teeth of the rack. A safety yoke 21 is releasably connected in a suitable but unillustrated manner to the supporting plate 15; in its position of use, the yoke prevents detachment of the mast 1 from the supporting plate 15 and additionally guides same in the longitudinal direction towards the free end of the bifurcated member 18. In this construction a number of fixed connecting points for the mast 1 to the sailing board 2 is provided that corresponds to the number of tooth gaps. Alteration of the connecting points is effected as in the first embodiment by simple lifting, transferring and lowering of the mast.

In departure from the FIG. 3 embodiment, it is also possible to use the rack 19 as the lower member of the universal joint so that the shaft 10 is dispensed with and the two members 17 and 18 can be combined and made correspondingly smaller.

I claim:

1. Apparatus for connecting a sailing mast to a sailing board having a longitudinal dimension comprising a linking member, means for pivotably attaching said linking member to the foot of a mast, connecting means for connecting said linking member to a sailing board, said connecting means comprising means for moving said linking member in a plane along the longitudinal dimension of the sailing board so that the mast can be lifted, fixed and firmly maintained in at least two positions along the longitudinal dimension of the sailing board.

2. Apparatus in accordacne with claim 1, wherein said linking member comprises a carrier plate, said means for moving said linking member comprise at least one lever pivotably connected at one end to said carrier plate, a supporting plate, means for mounting the supporting plate on the sailing board, said lever pivotably connected at its other end to the supporting plate wherein said carrier plate can be moved between two limiting positions in which the carrier plate rests on said supporting plate.

3. Apparatus in accordance with claim 1, wherein said linking member comprises a carrier plate, said means for moving said linking member comprise a pair of levers each pivotably connected at one end to said carrier plate, a supporting plate, said pair of levers pivotably connected at its other end to said supporting plate, each lever of said pair of levers being equal in length to form a parallelogram linkage with the carrier plate and the supporting plate.

4. Apparatus in accordance with claim 1, wherein the linking member includes a pin at its end remote from the mast, said means for moving said linking member comprise a supporting plate, means for mounting the supporting plate on the sailing board, a rack mounted on the supporting plate, said rack comprising a plurality of teeth, wherein said pin can be moved longitudinally along said rack for support between adjacent teeth of the rack.

5. Apparatus in accordance with claim 4, wherein a latch means is detachably mounted on said supporting plate for preventing detachment of said mast.

* * * * *